United States Patent [19]

Dove

[11] 4,072,260

[45] Feb. 7, 1978

[54] APPARATUS FOR TRANSPORTING AN ELONGATE PIECE OF MATERIAL

[75] Inventor: Michael David Dove, Cambridgeshire, England

[73] Assignee: Wainco Products Limited, England

[21] Appl. No.: 728,765

[22] Filed: Oct. 1, 1976

[30] Foreign Application Priority Data

Jan. 5, 1976 United Kingdom ..... 134/76

[51] Int. Cl.[2] ..... B65H 5/14; B65H 17/34

[52] U.S. Cl. ..... 226/173; 271/205; 354/345

[58] Field of Search ..... 226/173; 271/204–206, 271/277; 354/319–322, 345–347

[56] References Cited

U.S. PATENT DOCUMENTS

| | | | |
|---|---|---|---|
| 1,472,902 | 11/1923 | Bulkeley | 226/173 X |
| 1,991,137 | 2/1935 | Case et al. | 226/173 X |
| 3,000,289 | 9/1961 | Horiuchi | 355/322 |
| 3,366,025 | 1/1968 | Layne | 355/322 |
| 3,598,298 | 8/1971 | Diener | 226/173 |
| 3,868,053 | 2/1975 | Arnold | 226/173 |

*Primary Examiner*—Robert W. Saifer
*Attorney, Agent, or Firm*—William R. Liberman

[57] ABSTRACT

An apparatus is provided for transporting an elongate piece of material along a predetermined path. The apparatus includes a flexible endless driven belt, for example of a plastic material, which is guided, for example by rollers along the predetermined path. Spaced clips are secured to the belt for engaging the edge region of the piece of material. The material is engaged by some of the clips at a feed station, carried along the path, and then disengaged from the clips.

In a particularly advantageous application of the invention the piece of material is a length of photographic material, and the predetermined path runs through a photographic processing installation.

6 Claims, 4 Drawing Figures

APPARATUS FOR TRANSPORTING AN ELONGATE PIECE OF MATERIAL

FIELD OF THE INVENTION

This invention relates to an apparatus for transporting an elongate piece of material along a predetermined path, and is particularly concerned with the transport of lengths of photographic film or film print materials through a processing installation.

BACKGROUND OF THE INVENTION

The method commonly used in automatic film processing machines is to suspend strips of film to be processed from one end and successively lower the strips into and raise them out of a succession of baths containing the various materials needed to process the film. This method is, however, very cumbersome, and there is a need for an apparatus which is capable of efficiently transporting elongate pieces of material along a predetermined path, and in particular transporting lengths of photographic material through a film processing installation.

SUMMARY OF THE INVENTION

The invention provides an apparatus for transporting an elongate piece of material along a predetermined path, comprising a flexible endless belt, a plurality of spaced clips secured to the belt and adapted to engage a lateral edge region of the material, guide means for guiding the belt along the predetermined path, and drive means for applying drive to the belt.

DETAILED DESCRIPTION OF PREFERRED EMBODIMENT

Figure 1:
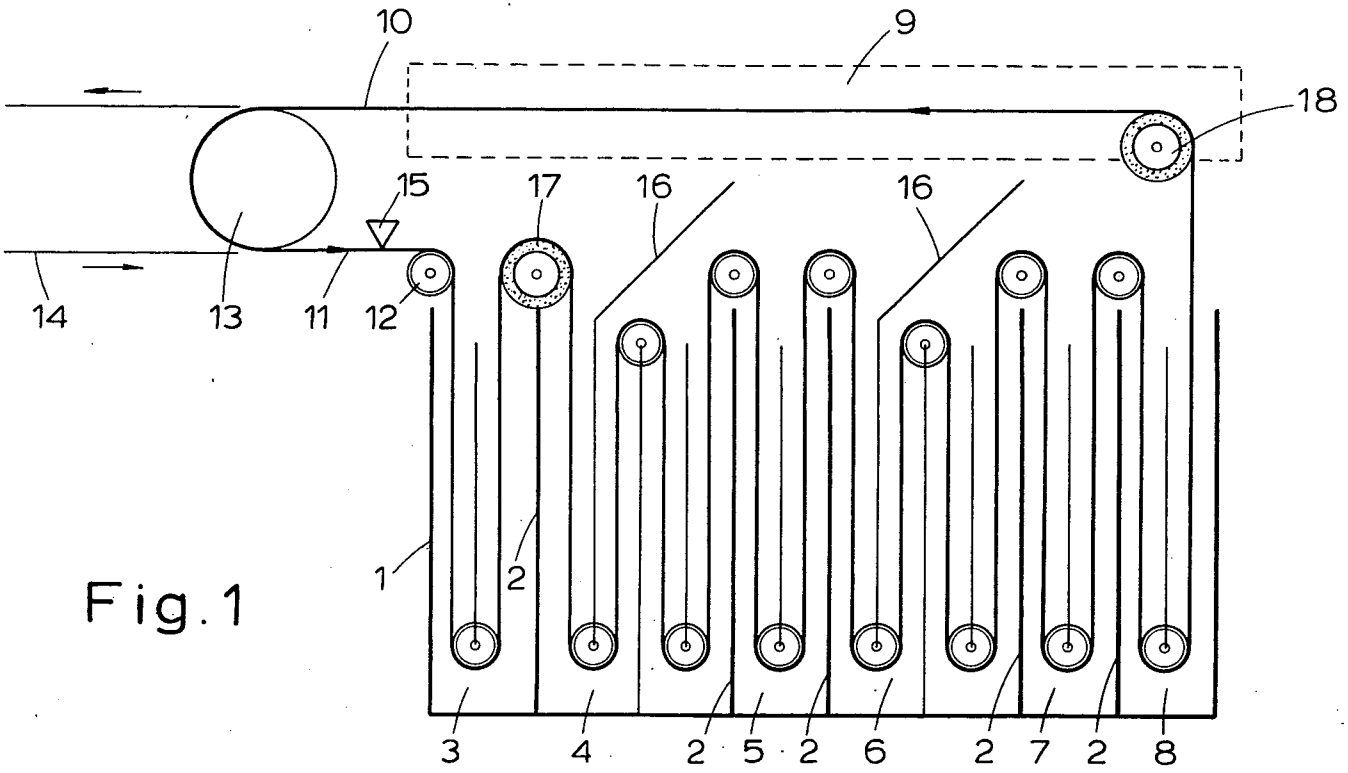
FIG. 1 is a diagrammatic view of a film processing installation incorporating an embodiment of the present invention.

FIG. 1 shows a film processing tank 1 which is divided by partitions 2 into a number of separate baths. In the form of tank shown in FIG. 1 there is successively provided a developer bath 3, a bleach bath 4, a washing bath 5, a fixer bath 6, a further washing bath 7, and a stabilizer bath 8. This tank is suitable for developing a color print film. It will be appreciated, however, that the present invention is equally applicable to any other form of film development, and that other types of film would require different successions of baths. A drying zone 9 is also provided.

Figure 2:
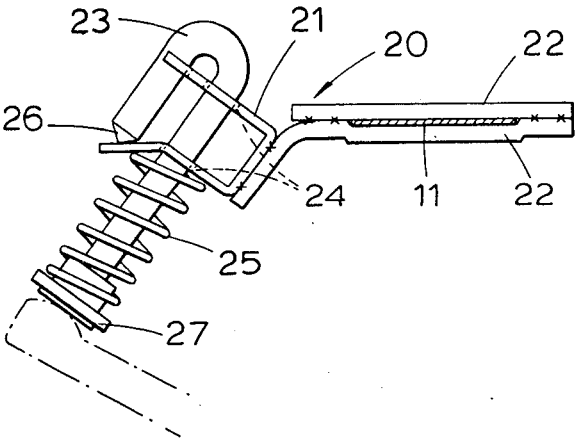
FIG. 2 is an enlarged side view of a clip for use in the present invention.

A continuous belt 10, formed, for example, of a Mylar strip, is arranged to travel in the direction indicated by the arrow 11 through the processing installation. The belt passes in a sinuous fashion through the tank 1, being guided for this purpose by a plurality of crowned guide rollers 12. After leaving the tank 1, the belt passes into and through the drying zone 9, and is returned to the tank 1 via a wheel 13. The construction of this wheel will be described in more detail below with reference to FIGS. 3 and 4. Secured to the belt 10 at equal intervals therealong, are a plurality of clips; these clips are not shown in FIGS. 1, but are illustrated in FIG. 2. The clips are spaced along the belt at equal intervals, the interval between adjacent clips being exactly equal to half the circumference of the wheel 13. The reason for this will become apparent in the detailed description below of the operation of the wheel 13. A length of film 14 which is to be processed is introduced into the apparatus at the left hand side thereof, and one lateral edge thereof is engaged in the region of the wheel 13 by a plurality of the clips. When the film 14 is very narrow it is necessary to ensure that the spacing of the clips is such that the clips engage the film between adjacent frames. The plane of the film is substantially parallel to the plane of the belt 10. The film is then carried by the belt through the processing tank, thence through the dryer 9, and so back to the upper side of the wheel 13. At this point the clips disengage the film which is then free to pass out of the apparatus.

A film detector 15, illustrated only schematically, is positioned after the wheel 13. The purpose of this detector is to sense when the film 14 has passed sufficiently far into the apparatus for a further section of film 14 to be introduced. It will be appreciated that as the belt 15 is considerably longer than a typical length of film to be processed, a substantial number of film lengths can be processed simultaneously. FIG. 1 also shows splash guards 16 which are designed to prevent liquid in one bath splashing over into an adjacent bath, a danger which is present particularly when the tail of a film length is entering a bath. It will be observed that the roller provided at the top of the partition 2 dividing baths 3 and 4 has a layer 17 of absorbent material, for example a foam plastics material, provided thereon. The purpose of this layer is to remove as completely as possible any developer which may be present on the clips as they leave the developer tank. It will be seen that unlike the bleach and fixer baths the developer bath is not immediately followed by a wash, and for this reason it is important to ensure as far as possible that no developer is carried out of the developer tank to contaminate succeeding baths. It has been found in practice that developer absorbed by the layer 17 drips almost entirely back into the developer bath 3, and very little enters the bleach bath 4. Means are provided for agitating the liquids in the tank, and means are also provided for maintaining the liquids at an appropriate temperature. Both these means are entirely conventional in construction, and well known in the art, and it is not believed that any description of them is necessary. A roller 18 which is positioned at the entry of the belt into the drying zone 9 is also covered with a layer of absorbent material, in this case to produce as much drying as possible of the clips before the belt carrying the film enters the drying zone.

Reference will now be made to FIG. 2 which illustrates on an enlarged scale, a clip 20 used to engage a lateral edge of the film. The clip 20 comprises a U-shaped member 21, and a pair of parallel plates 22 which engage the belt 11. A U-shaped film engaging member 23 has one of its arms received in apertures 24 in the member 21 and is spring-loaded by a spring 25 which urges it towards the lower of the two arms of the member 21. The member 23 has a pointed end 26, and in use a film to be transported is engaged between the pointed end the adjacent part of the member 21. The lower end of the spring 25 bears against the circular plate 27 which is rivetted to member 23. It should be noted that the arms of the member 23 are not at right angles to the plates 22 but rather define an obtuse angle therewith.

This is of significance in the operation of the wheel 13, as will be apparent from the ensuing description.

Figure 4:
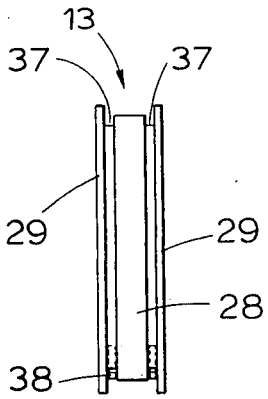
FIG. 4 is an end view of the wheel shown in FIG. 3.
Figure 3:
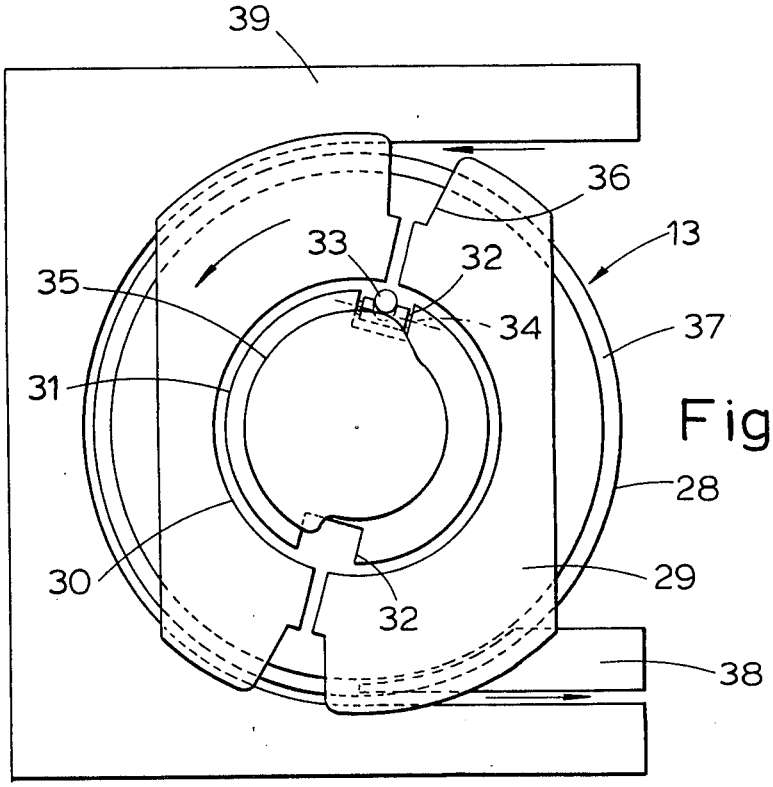
FIG. 3 shows a drive wheel forming part of the installation.

FIGS. 3 and 4 show in more detail the wheel 13. This wheel has three functions; it drives the belt 11, it causes the clips 20 to engage an incoming film, and it causes the clips 20 to disengage an outgoing film. To fulfil the first of these functions the wheel is provided with a suitable drive [not shown] which could be, for example, an electric motor. The wheel comprises a central core 28 and a pair of side plates 29. For convenience each side plate can be sub-divided into two halves, as shown in FIG. 3. The side plates 29 have a central aperture 30, and a lateral extension 31 from the core 28 extends into the aperture in each side plate 29. Each extension 31 is provided with a pair of cut-outs 32 in which a cam follower 33 is pivotally mounted. For simplicity of illustration only one of the cam followers is shown. Each cam follower 33 is mounted to be pivoted about an axis 34 and is biassed by a spring [not shown] into contact with a stationary cam 35.

Adjacent each cam follower 33 the side plate 29 is provided with cut-out 36, the purpose of which will be apparent from the description below of the operation of the wheel. Also, the core 28 has a pair of circumferential grooves 37 into which extend two forks 38 which act as a tape-stripper. The operation of these is also described below.

In operation, the belt 11 passes round the wheel between the plates 29 and in contact with periphery of the core 28. The belt 11 is, of course, carrying clips 20, and as a clip 20 approaches the upper side of the wheel 13 it is partially received in a cut-out 36. The orientation of the clip is such that the arm of the U-shaped member 23 which carries the spring 25 and plate 27 is directed towards the cam follower 33. As the wheel continues to rotate the cam follower 33 is pivoted by the rising portion of the cam 35 so that it strikes the plate 27. This causes the U-shaped member 23 to move upwardly against the force of the spring 25, and thus allows the clip to release the edge of the film which has until now been held between the tip 26 and the adjacent part of the member 24. In this way each clip is successively released from the length of film and the film is thereby released from the belt 11. The film continues to travel in a left-ward direction and passes out of the apparatus through a suitable outlet, for example between a pair of rollers. The belt carrying the clips continues to travel around the wheel towards the lower portion thereof. At the lower portion the reverse operation takes place. The lateral edge of a length of film introduced from the left hand side of the wheel passes between the tip 26 and the adjacent part of the member 24 of a succession of clips. As the wheel continues to rotate the cam follower reaches a sharply falling part of the cam 35, and pivots out of contact with the plate 27. Under the action of the spring 25 the tip 26 moves to engage the edge of the film, and the film edge is thus successively clamped by a plurality of clips.

A U-shaped yoke 39 partially surrounds the core 28 in order to prevent movement of the clips 20 perpendicular to the plane of the wheel 30 when they are engaged by the cam followers 33. The purpose of the strippers 38 is to assist in release of the belt 11 from the wheel. If this stripper is not provided there is a tendency for the clips to remain in the cut-outs 36 of the wheel after it has passed the lowest point on the wheel, and this gives rise to an undesirably jerky operation.

The film may be introduced into the apparatus in any suitable manner. One appropriate way is to load the film into a loading box so that it is entirely enclosed within the box except for a short lateral edge portion at its forward end. The entire box containing the film is then loaded into the apparatus in such a manner that the exposed lateral edge is engaged by a clip at the lower side of the wheel 13. The first clip to engage the film begins the process of withdrawing the film from the loading box, and the film is then successively engaged by a plurality of clips until the entire length of film has been withdrawn. When the film detector 15 senses that the length of film has been introduced into the apparatus the loading box can be withdrawn and a fresh length of film introduced in a similar manner. It will be appreciated that there are alternative methods of introducing the film.

We claim:

1. An apparatus for transporting an elongate piece of material along a predetermined path, comprising a flexible endless belt, a plurality of spaced clips secured to the belt and adapted to engage a lateral edge region of the material, guide means for guiding the belt along the predetermined path, and drive means for applying drive to the belt, and including a feed station at which, in use, the said piece of material is engaged by some of the clips, a removal station at which the said piece of material is disengaged from the clips, cam means for effecting engagement and disengagement of the clips, a wheel having clip-engaging cut-outs, and a pair of cam followers movable with the wheel, the cam being arranged to move the cam followers at the feed station and removal station to respectively cause engagement and disengagement of the piece of material by the clips.

2. An apparatus according to claim 1, wherein means are provided for stripping the clips from the wheel at the removal station.

3. An apparatus according to claim 1, wherein each clip is provided with spring means for biassing it to a material-engaging position.

4. An apparatus according to claim 1, wherein the elongate piece of material is a length of photographic material, and the apparatus is so arranged that the photographic material is transported in a sinuous path through a plurality of baths containing photographic treatment material, and wherein a foam-covered roller is arranged at at least one location on the said predetermined path between two adjacent baths so as to reduce transfer of photographic treatment material from one bath to the next.

5. An apparatus according to claim 1, wherein a sensor is arranged to detect when the photographic material has passed a set point on the said predetermined path.

6. An apparatus for transporting an elongate piece of material along a predetermined path comprising a flexible endless belt, a plurality of spaced clips secured to the belt, each engaging a laterial edge region of the material, guide means for guiding the belt along the predetermined path, drive means for applying drive to the belt, each clip including spring means to bias it to a material-engaging position, the material-engaging means being movable by said spring means in a direction to define an obtuse angle with the plane of flexible belt.

* * * * *